US010117799B2

(12) United States Patent
Saayman

(10) Patent No.: US 10,117,799 B2
(45) Date of Patent: Nov. 6, 2018

(54) LIFTING DEVICE FOR DISABLED PERSON

(71) Applicant: Jacobus Hendrik Saayman, Carindale (AU)

(72) Inventor: Jacobus Hendrik Saayman, Carindale (AU)

( * ) Notice: Subject to any disclaimer, the term of this patent is extended or adjusted under 35 U.S.C. 154(b) by 149 days.

(21) Appl. No.: 14/653,920

(22) PCT Filed: Dec. 20, 2013

(86) PCT No.: PCT/IB2013/061195
§ 371 (c)(1),
(2) Date: Jun. 19, 2015

(87) PCT Pub. No.: WO2014/097247
PCT Pub. Date: Jun. 26, 2014

(65) Prior Publication Data

US 2015/0313783 A1 Nov. 5, 2015

(30) Foreign Application Priority Data

Dec. 20, 2012 (ZA) ..... 2012/09662

(51) Int. Cl.
*A61G 7/10* (2006.01)

(52) U.S. Cl.
CPC ..... *A61G 7/1019* (2013.01); *A61G 7/1046* (2013.01); *A61G 7/1051* (2013.01); *A61G 7/1067* (2013.01); *A61G 2200/34* (2013.01)

(58) Field of Classification Search
CPC .. A61G 7/1013; A61G 7/1019; A61G 7/1017; A61G 7/1051; A61G 7/1067;
(Continued)

(56) References Cited

U.S. PATENT DOCUMENTS 3,188,657 A * 6/1965 Cotner ..... A61G 7/1003 4/562.1
3,356,184 A * 12/1967 Bidgood ..... A61G 7/1019 187/231

(Continued)

FOREIGN PATENT DOCUMENTS

DE 3615412 Al 11/1987
EP 1110530 Al 6/2001

(Continued)

*Primary Examiner* — Peter M. Cuomo
*Assistant Examiner* — Ifeolu A Adeboyejo
(74) *Attorney, Agent, or Firm* — David A. Guerra

(57) ABSTRACT

The invention provides a lifting device (1) for transfer of a paraplegic between seated positions. A post (3) extends from a wheeled base (2) and movably supports a head (5) for upwards and downwards movement. A lifting arm arrangement (7) is pivotably secured to the head (5). The head (5) is also rotatable about the post (3) and the base (2) movable between an expanded stabilizing condition and a retracted condition. The latter condition allows the lifting device (1) to fit through a standard width doorway. Movement of the base (2) between these conditions is effected by pivoting of the lifting arm arrangement (7) into and out of a lateral supporting position. The base (2) preferably includes five legs (4) extending substantially radially from the post (3) with two of the legs (4) foldable towards adjacent legs (4).

14 Claims, 10 Drawing Sheets

(58) Field of Classification Search
CPC .. A61G 7/018; A61G 2200/34; A61G 7/1076; A61G 7/1046
See application file for complete search history.

(56) References Cited

U.S. PATENT DOCUMENTS 3,394,933 A * 7/1968 Benoit ..... A61G 7/1019 254/4 R
3,815,163 A * 6/1974 Sullivan ..... A61G 7/1003 4/562.1
3,879,770 A * 4/1975 Grant ..... A61G 7/1003 4/563.1
3,940,808 A * 3/1976 Petrini ..... A61G 7/1019 5/81.1 RP
4,117,561 A * 10/1978 Zamotin ..... A61G 7/1015 5/83.1
4,206,523 A * 6/1980 James ..... A61G 7/1019 4/562.1
4,571,758 A * 2/1986 Samuelsson ..... A61G 7/1019 4/460
5,077,844 A * 1/1992 Twitchell ..... A61G 7/1017 212/232
5,333,333 A * 8/1994 Mah ..... A61G 5/10 280/250.1
5,432,961 A * 7/1995 Horton ..... A61G 7/1005 4/496
5,459,891 A * 10/1995 Reeve ..... A61G 7/1017 212/231
5,697,110 A * 12/1997 Campbell ..... A61G 7/1019 177/144
5,708,993 A 1/1998 Campbell et al.
6,026,523 A 2/2000 Simon et al.
6,112,346 A * 9/2000 Agadzi ..... A61G 7/1015 5/83.1
6,119,287 A * 9/2000 Phillips ..... A61G 7/1017 5/81.1 RP
6,430,761 B1 * 8/2002 Brandorff ..... A61G 7/053 5/81.1 R
6,964,070 B2 * 11/2005 Hawk ..... A61G 7/05 5/81.1 R
7,003,820 B1 * 2/2006 Iura ..... A61G 7/053 135/67
8,171,587 B1 * 5/2012 Haessly ..... A61G 7/1025 5/662
8,336,133 B2 * 12/2012 Palay ..... A61G 5/14 5/81.1 R
8,572,774 B1 * 11/2013 Osika ..... A61H 1/0255 5/662
8,584,275 B2 * 11/2013 Nelson ..... A61G 7/1017 5/81.1 R
2003/0110561 A1 * 6/2003 Porcheron ..... A61G 7/1019 5/86.1
2006/0031984 A1 2/2006 Takizawa
2013/0007957 A1 * 1/2013 Chun ..... A61G 7/1019 5/87.1

FOREIGN PATENT DOCUMENTS

EP 2380543 Al 10/2011
GB 2072139 9/1981
JP S60156459 8/1985
JP H10234793 9/1998

* cited by examiner

C

D

LIFTING DEVICE FOR DISABLED PERSON

CROSS REFERENCE TO RELATED APPLICATION

This application is for entry into the U.S. National Phase under § 371 for International Application No. PCT/IB2013/061195 having an international filing date of Dec. 20, 2013, and from which priority is claimed under all applicable sections of Title of the United States Code including, but not limited to, Sections 120, 363, and 365(c), and which in turn claims priority under 35 USC 119 to South African Patent Application No. 2012/09662 filed on Dec. 20, 2012.

FIELD OF THE INVENTION

This invention relates to a lifting device for a disabled person and more specifically, but not exclusively, to a lifting device for a paraplegic person to facilitate transfer from one seated position to another seated position.

BACKGROUND TO THE INVENTION

Paraplegia is an impairment of the lower extremities of a person's body. Paraplegics are able to use their shoulders and arms but cannot use their legs or muscles from the waist down. The disability presents various difficulties for a person's daily activities. One such difficulty is encountered where the disabled person needs to be transferred between a bed, a wheelchair and possibly a toilet seat.

Various devices exist to assist the transfer of the paraplegic to and from one seated position to another. One such device includes a base with wheels and slings on a lifting arm onto which the paraplegic positions himself. The lifting arm is then raised by lifting means such as a hydraulic jack and the device can then be manoeuvred into position, above the wheelchair, to lower the paraplegic into the wheelchair.

A problem with this type of device is that the paraplegic requires assistance to use the device.

OBJECT OF THE INVENTION

It is an object of this invention to provide a lifting device that, at least partially, alleviates some of the difficulties associated with the prior art.

SUMMARY OF THE INVENTION

In accordance with the invention there is provided a lifting device comprising a wheeled base with a post extending from the base, the post movably supporting a head for upwards and downwards movement, and the head having a lifting arm arrangement attached thereto, characterised in that the head is rotatable about the post and the base movable between an expanded stabilizing condition and a retracted condition.

The invention further provides for a lifting device as defined in which the lifting arm arrangement is pivotably secured to the head and movable between a supporting position and an inoperative position, and the arm arrangement is connected to the base through a linkage which moves the base into the stabilizing condition when the arm arrangement is in the supporting position and moves the base into the retracted condition when the arm arrangement is in the inoperative position; and in which the linkage secures the base in the stabilizing condition while the arm arrangement remains in the supporting position.

Further features of the invention provided for a lifting device as defined in which the lifting arm arrangement includes a pair of spaced apart arms extending from a cross-beam pivotably secured to the head; and wherein the arms when in the supporting position extend laterally from the head and in the inoperative position extend upwardly from the head.

Further features of the invention provided for a lifting device as defined in which wheels of the base are arranged substantially equally spaced apart on a diameter about the post when the base is in the stabilizing condition; in which the base includes a plurality of legs extending substantially radially from the post in the stabilizing condition, with at least one of the legs being movable from a radial position towards an adjacent leg to bring the base into the retracted condition; having five legs, two of which are hingedly connected to the post and foldable towards adjacent legs.

Further features of the invention provided for a lifting device as defined in which the head includes an actuator, for movement relative to the post, accessible to a person supported by the lifting arm; and in which the actuator is a rotatable handle provided on the head.

Further features of the invention provided for a lifting device as defined in which the handle is rotatable in opposite directions to rotate the head alternately about the post; and in which the handle turns an outer rotary gear, rotatably supported in relation to the head that runs on track provided by an inner annular gear, which is coaxial and fixed relative to the post.

Further features of the invention provided for a lifting device as defined in which the handle is rotatable in opposite directions to respectively raise and lower the head on the post; and in which the handle axially turns a screw-threaded rod rotatably fixed to the head which extends through a correspondingly screw-threaded bore in a carrier fixed to the post.

BRIEF DESCRIPTION OF THE DRAWINGS

One embodiment of the invention is described below, by way of example only, with reference to the accompanying drawings, in which.

DETAILED DESCRIPTION OF THE INVENTION

Figure 1:
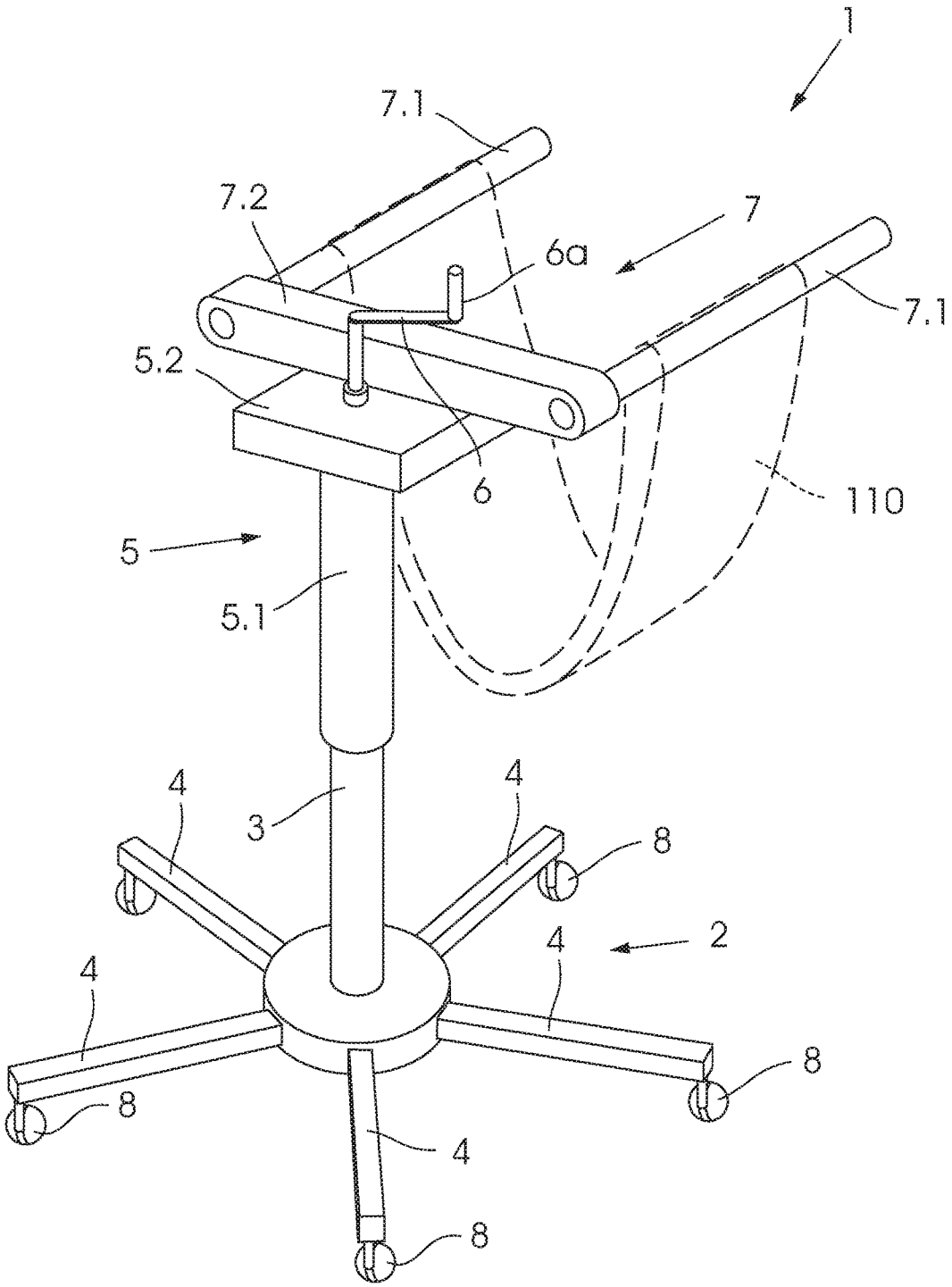
FIG. 1 is a perspective view of a lifting device.

With reference to the drawings, in which like features are indicated by like numerals, a lifting device or lift is generally indicated by reference numeral (1).

The lift (1) includes a base (2) and a post (3) extending from the base. The base (2) comprises a plurality of legs (4) which extend substantially laterally from a hub at the lower end of the post (3). The legs (4) are each provided with a castor wheel (8) at the outer end thereof. In this embodiment, there are five legs (4) which are radially arranged and equally spaced apart with the base (2) expanded in a stabilizing condition as shown in FIGS. 1 and 2.

A head (5) is movably supported by the post (3). The head includes a sleeve (5.1) located over the upper end of the post (3). The sleeve (5.1) forms a telescopic extension of the post (3). At the top of the sleeve (5.1) is a housing (5.2). The configuration of the housing (5.2) will vary depending on the mechanisms required for operation of the lift (1). Examples of these are described below.

A lifting arm arrangement (7) is supported on the housing (5.2) of the head (5). The arrangement (7) includes a pair of spaced apart lifting arms (7.1) which extend from a cross-beam (7.2) that is pivotably connected to the head (5). A sling (110) is removably securable to the arms (7.1), for supporting a person's lower body when using the lift (1).

Figure 2:
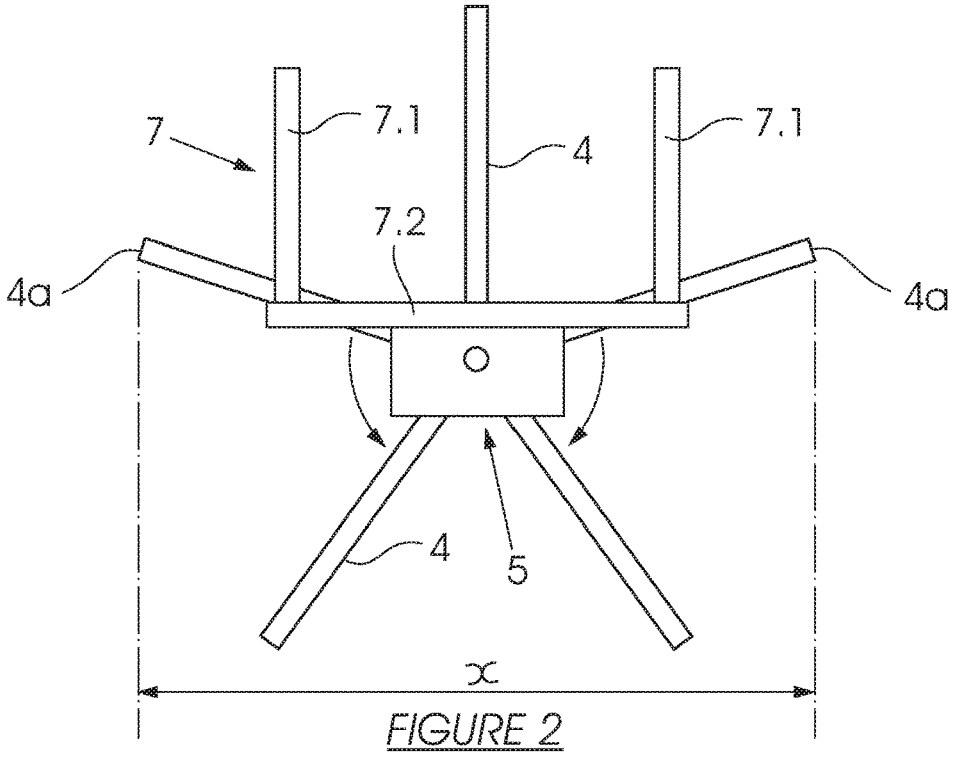
FIG. 2 is a schematic plan view of a lifting device, with the base in a stabilizing condition.
Figure 3:
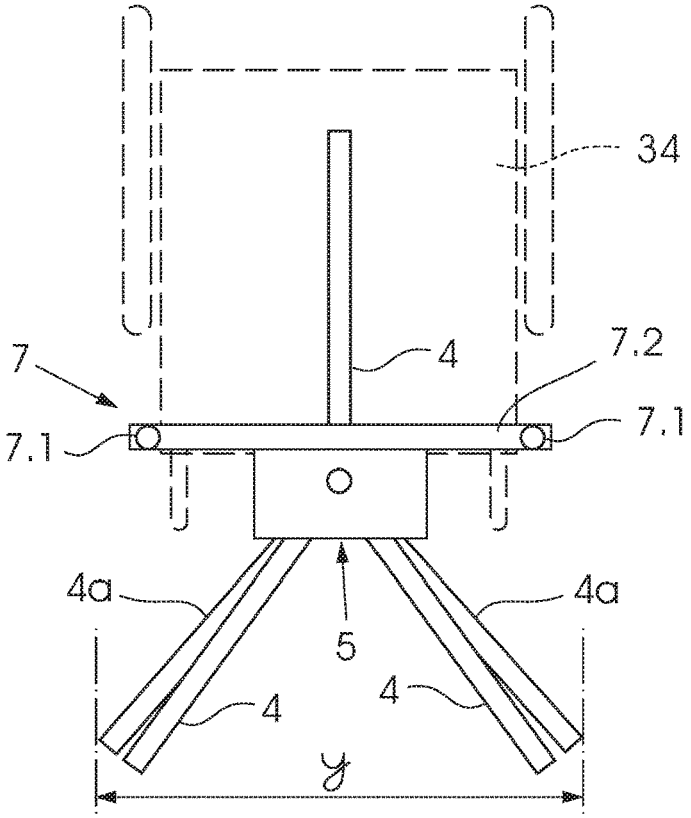
FIG. 3 is a schematic plan view of the lifting device in FIG. 2, with the base in a retracted condition.
Figure 4:
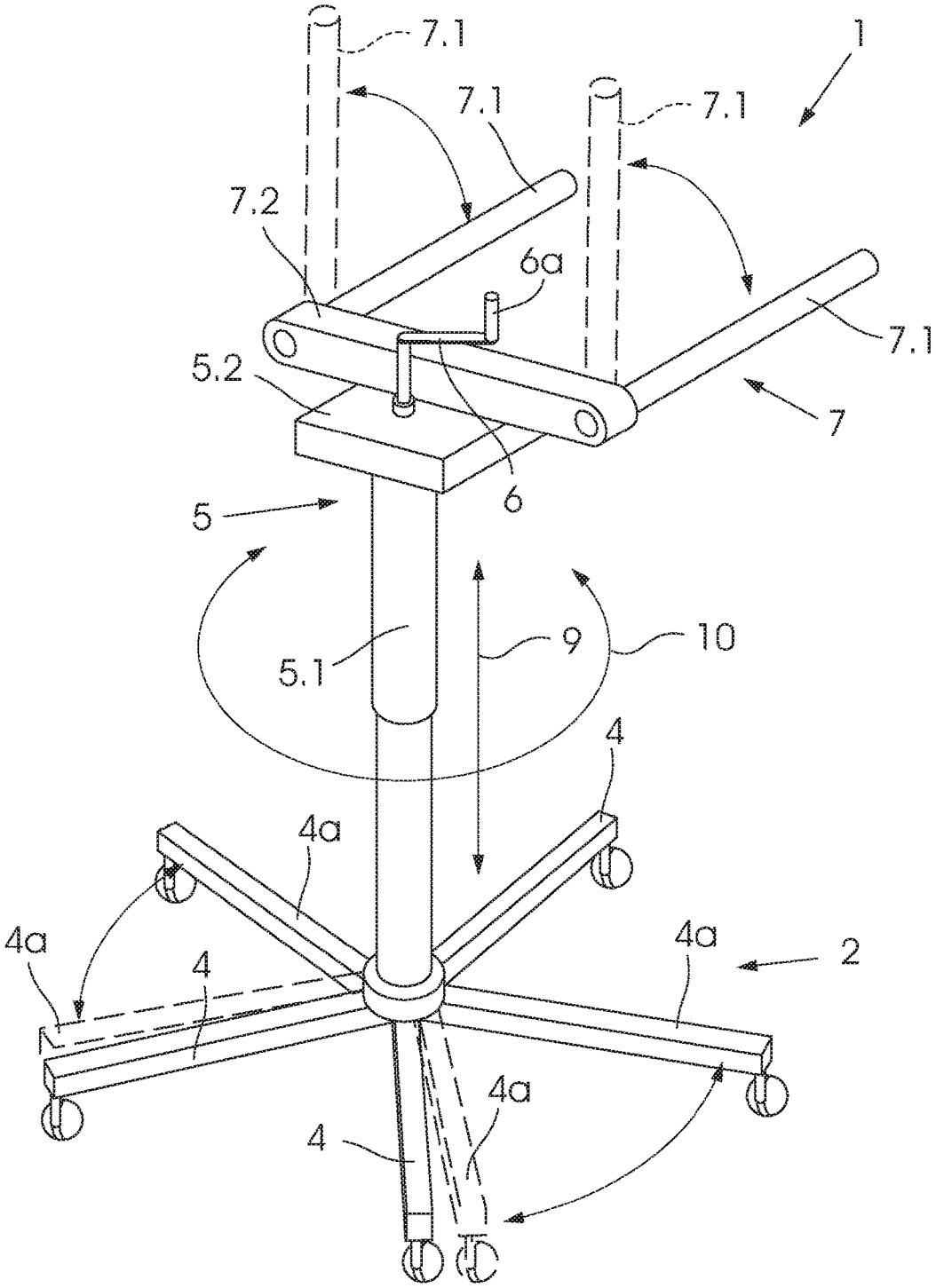
FIG. 4 is a perspective view of a lifting device, showing the positions between which the legs and lifting arm arrangement may move.

With reference to FIGS. 2 to 4, two of the legs (4*a*) are movable between a stabilizing extended position wherein each leg (4*a*) extends radially outwardly from the base (2) to widen the effective width "x" of the base (2), and a inoperative, folded position wherein each of the movable legs (4*a*) is hinged at the bottom of the post (3) towards adjacent legs (4), to decrease the effective width "y" of the base (2). With the legs (4*a*) in the latter position, the base (2) is in a retracted condition.

This operation of the movable legs (4*a*) is effected through pivoting of the lifting arm arrangement (7) as described below, to move the base (2) between the stabilizing condition and a retracted condition.

The head (5) is movable upwardly and downwardly (as indicated by arrow (9) in FIG. 4) and is also rotatable about the post (as indicated by arrow (10) in FIG. 4). The lift (1) includes an actuator in the form of a rotatable lever (6) for moving the head (5) relative to the post (3) through the mechanisms referred to below. The head (5) and post (3) are guided for relative axial, rotational movement and longitudinal, sliding movement by polymeric, typically Vesconite™, bearings as illustrated in the detail view C of FIG. 5.

Figure 5:
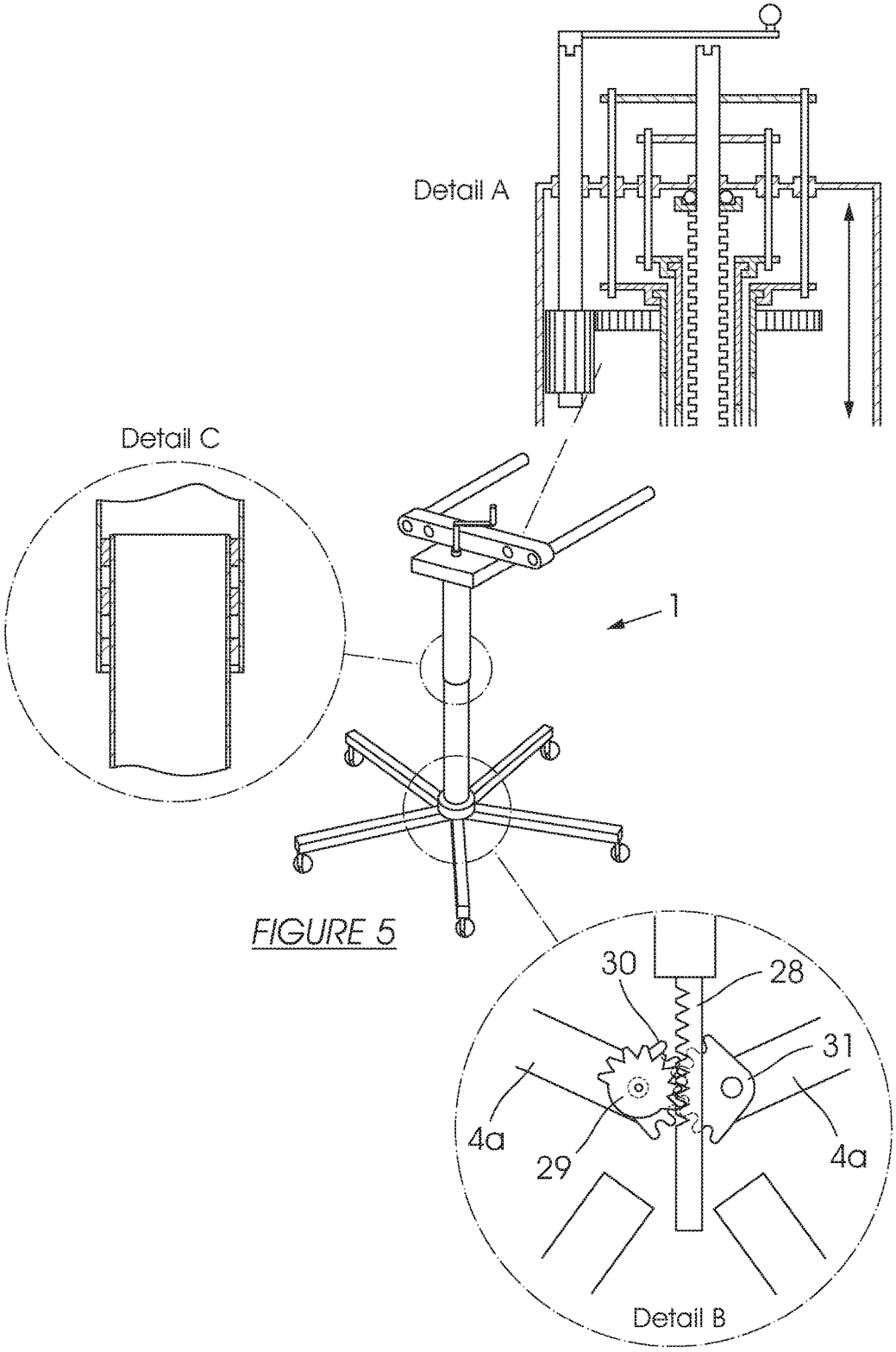
FIG. 5 is a perspective view of a lifting device showing detail views A, B and C of different portions of the lifting device.
Figure 5B:
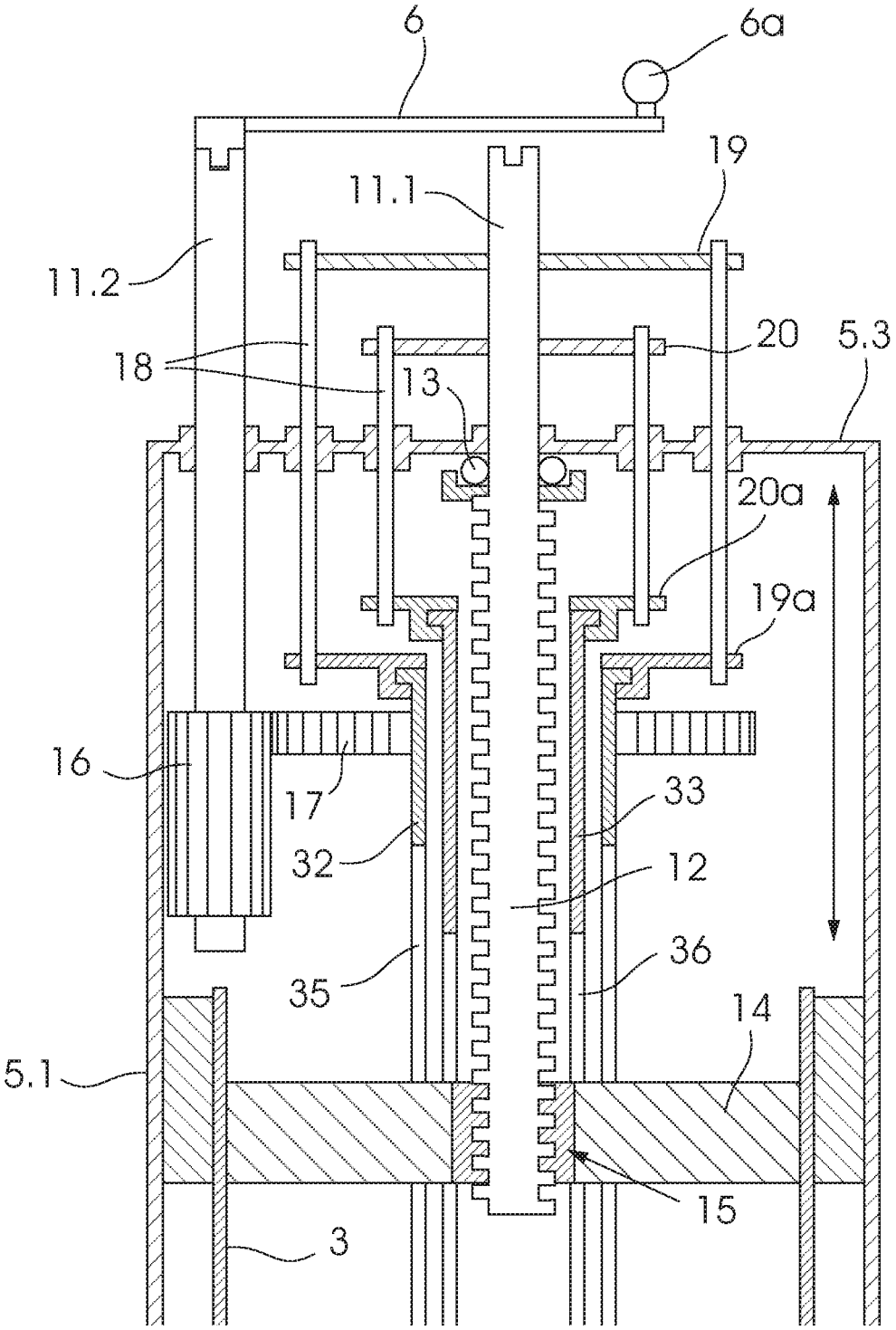
FIG. 5*b* is an enlarged cross-sectional view of detail view A of FIG. 5 including reference numerals.

The rotatable lever (6) is removably securable to either of two protrusions (11.1) and (11.2)—only one of these is illustrated in FIGS. 1 to 4, but both are shown in FIG. 5*b*. The components shown in FIGS. 5 to 8 will be enclosed inside the housing (5.2) with only the protrusions (11.1) and (11.2) exposed therethrough for operation.

The lever (6) will typically click into position on each of the protrusions (11.1) and (11.2) through splined socket and spigot formations which may include a spring loaded detent. The lever (6) may also be extendable to provide a mechanical advantage for use by weaker persons who require more leverage to operate the lift (1). A rotatable, perpendicular handle (6*a*) extends upwardly at the end of the lever (6). The combination provides a crank handle for convenient rotation of the protrusions (11.1) and (11.2).

The first protrusion (11.1) (see FIGS. 5*b* and 6) drives a screw-threaded rod (12). The screw-threaded rod (12) is rotatably secured to the head (5) through a bearing arrangement (13). The length of the rod (12) extends through a carrier (14), which is fixed to the post (3). The carrier (14) includes a central, correspondingly screw-threaded bore (15) which engages on the rod (12). The bearing arrangement (13) is secured adjacent an upper end of the rod (12) and adjustably supports the head (5) above the post (3). The bore (15) may be provided by a ball screw assembly, to reduce frictional resistance to passage of the screw-threaded rod (12).

Rotating the lever (6) when fitted to the first protrusion (11.1) in one direction raises the head (5) relative to the post (3), and rotating the lever (6) in the opposite direction lowers the head (5) relative to the post (3).

The second protrusion (11.2), with the lever (6) attached thereto in detail view of FIG. 5*b*, is secured to a small outer gear (16) which meshes with and turns on a large inner gear (17). Outer gear (16) is attached to the head (5) whilst inner gear (17) is attached to a cylindrical member (32) which extends slidably through the carrier (14) but is unable to rotate relative to the carrier (14).

The outer gear (16) is longer than the inner gear (17) to allow for vertical travel of the inner gear (17) on the member (32) during the moving action of the legs (4*a*) as described below.

When the lever (6) is rotated on the second protrusion (11.2), the outer gear (16) travels about a toothed track provided by the inner gear (17) and the head (5) rotates relative to the post (3). This allows a person using the lifting device (1), who is seated in the sling (110), to rotate himself or herself 360 degrees about the post (3). By moving the lever (6) to the first protrusion (11.1), the person may also raise or lower himself or herself.

The lifting arms (7.1) are movable, by pivoting of the cross-beam (7.2) on the housing (5.2), between a weight carrying or supporting position (as shown in FIGS. 1, 2 and 5) and an inoperative position (shown in broken lines in FIG. 4). In the weight carrying position the lifting arms (7.1) extend laterally or horizontally from the head (5), and in the inoperative position the lifting arms (7) extend longitudinally or upwardly from the head (5). To facilitate such pivoting, it is envisaged that the cross-beam (7.2) may also be fitted with a handle (not shown) which extends downwardly. The handle will allow a user to pull the beam (7.2) into the inoperative position.

It is desirable that the movable legs (4*a*) must be securable and remain in the stabilizing, extended position whilst a person is using the device (1). This is accomplished through movement means (the components of which are schematically illustrated in FIGS. 6 to 10). As already mentioned, the movement means is controlled by pivoting of the arm arrangement (7) and its components provide a mechanical linkage to control the positioning of the movable legs (4*a*).

The movement and locking means includes a pair of cam followers (19) and (20) with connecting rods (18) which extend slidably through an upper end wall (5.3) of the head sleeve (5.1). The followers (19) and (20) are respectively connected to annular plates (19*a*) and (20*a*) by the rods (18). Both plates (19*a*) and (20*a*) have a central opening with an annular, radial slot provided therein. Radial flanges provided at the upper ends of cylindrical members (32) and (33) are respectively rotatably located inside the radial slots of plates (19*a*) and (20*a*).

The arrangement provides for the members (32) and (33) to be secured longitudinally to the plates (19*a*) and (20*a*), whilst being axially rotatable through the flange and slot connection. The members (32) and (33) have longitudinal slots (35) and (36) (see FIG. 5*b*) with portions of carrier (14) extending through the slots (35) and (36) to prevent the members (32) and (33) from rotating relative to the post (3) but allowing for limited vertical travel through the carrier (14). The members (32) and (33) are therefore also rotatable relative to the head (5) but unable to rotate relative to the post (3).

The followers (19) and (20) are accordingly moveable up and down with respect to the end wall (5.3) and the assembly of components described enables transfer of vertical movement of followers (19) and (20) to the members (32) and (33) but allows for relative rotational movement between these parts.

The bottom end of the member (33) is provided as a cup (37) with an annular flange (38) providing a stop which surrounds linear gear (21). A pair of gripping wedges (25) is positioned against the flange (38). The bottom end of the member (32) is located inside the cup (37) of the member (33) and provided with a tapered throat (39) which is located adjacent the wedges (25).

The wedges (25) will be resiliently biased away from teeth on the linear gear (21). The position of the tapered throat (39) relative to the wedges (25) is dependent on the spacing between the followers (19) and (20). When the tapered throat (39) of the member (32) closes over the wedges (25), in the operation described below, the wedges (25) will be pressed into engagement with the gear (21).

For operation by a pair of overlying cams (22) and (23), the followers (19) and (20) are spring biased upwardly, away from the end wall (5.3). The springs are not shown but can be of any suitable type and provided at any suitable position within the assembly.

The cams (22) and (23) are connected to the cross-beam (7.2) of the arm arrangement (7) which pivots relative to the housing (5.2) of the head (5). The cams (22) and (23) extend from the beam (7.2) into the housing (5.2) where they engage the followers (19) and (20). The two followers (19) and (20) are provided as plates. The plates (19) and (20) have aligned slots through which the cams (22) and (23) extend. Each follower (19) and (20) has a pin (19.1) and (20.1) extending across its slot. The pins (19.1) and (20.1) bear against the cams (23) and (22) respectively under action of the spring bias referred to.

Figure 6:
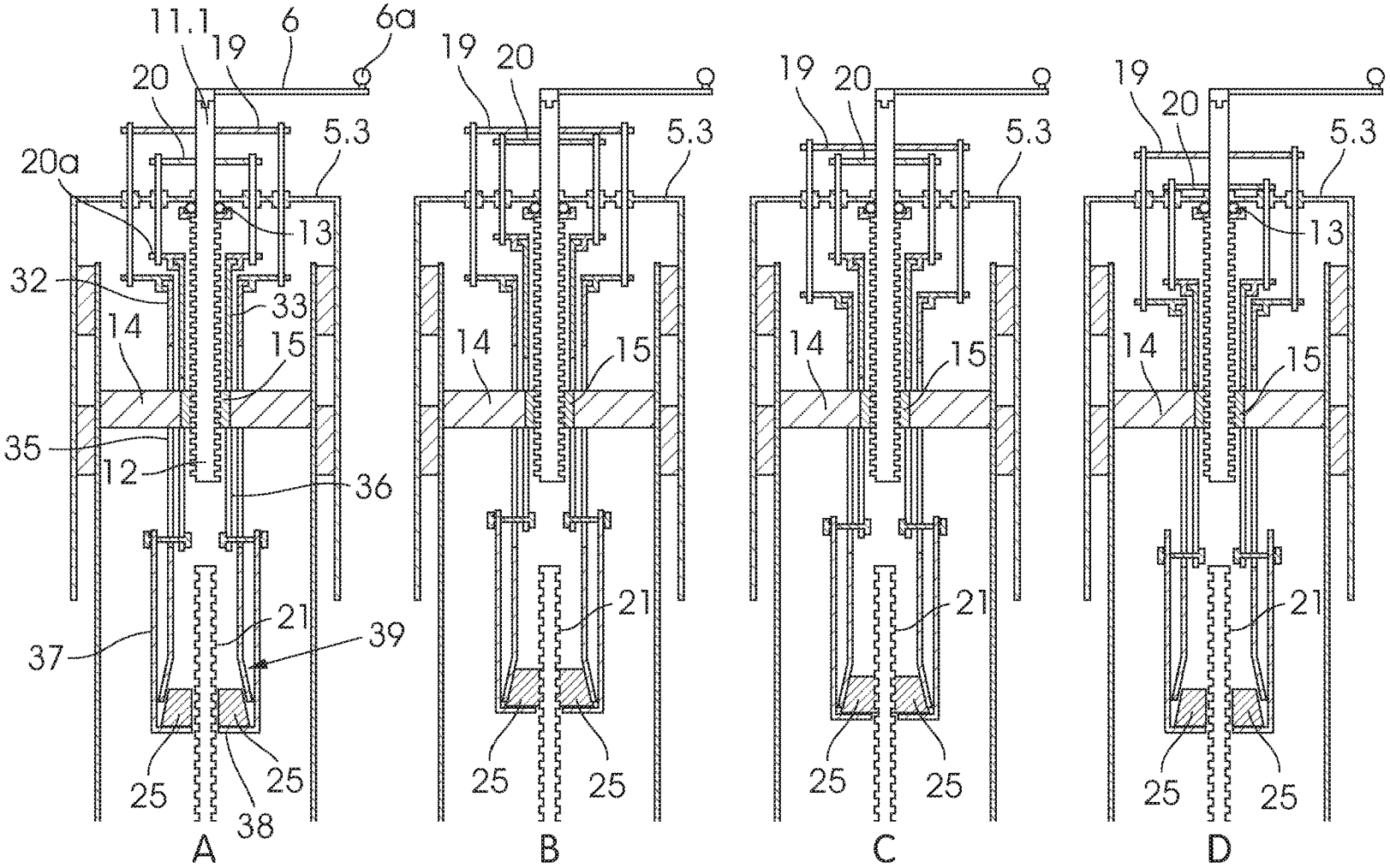
FIG. 6 provides four schematic cross-sectional views of components of movement means for legs of a lifting device.

Arrangement A in FIG. 6 shows second follower (20) in a central position and first follower (19) raised. This arrangement corresponds to arrangement A of the cams (22) and (23) shown in FIG. 7. The two followers (19) and (20) are supported spaced apart from each other by the cams (22) and (23). In this arrangement the lifting arms (7.1) are in the upward, inoperative position, raised vertically relative to the post (3), with the lifting device (1) in mobile mode, wherein the legs (4*a*) are in the folded position.

Moving the lifting arms (7) downward initially (as a person would do to use the device) allows the second follower (20) to rise in accordance with the indent (24) of cam (22). The space between the followers (19) and (20) is reduced.

As the second follower (20) is raised towards the first follower (19), wedges (25) close towards each other engaging onto a linear gear (21). This transition is shown in FIGS. 6 and 7, from the arrangement in views A to the arrangement in views B, wherein the linear gear (21) is fully engaged by the wedges (25).

On moving the lifting arms (7) further downward, second cam (22) lowers follower (20) and first cam (23) lowers follower (19). The close spacing between the followers (19) and (20) is maintained as the pins are displaced by the substantially corresponding curves of the two cams (22) and (23). This is shown in arrangement C in FIGS. 6 and 8. The followers (19) and (20) are accordingly lowered in unison with the engaged wedges (25) lowering linear gear (21).

Figure 7:
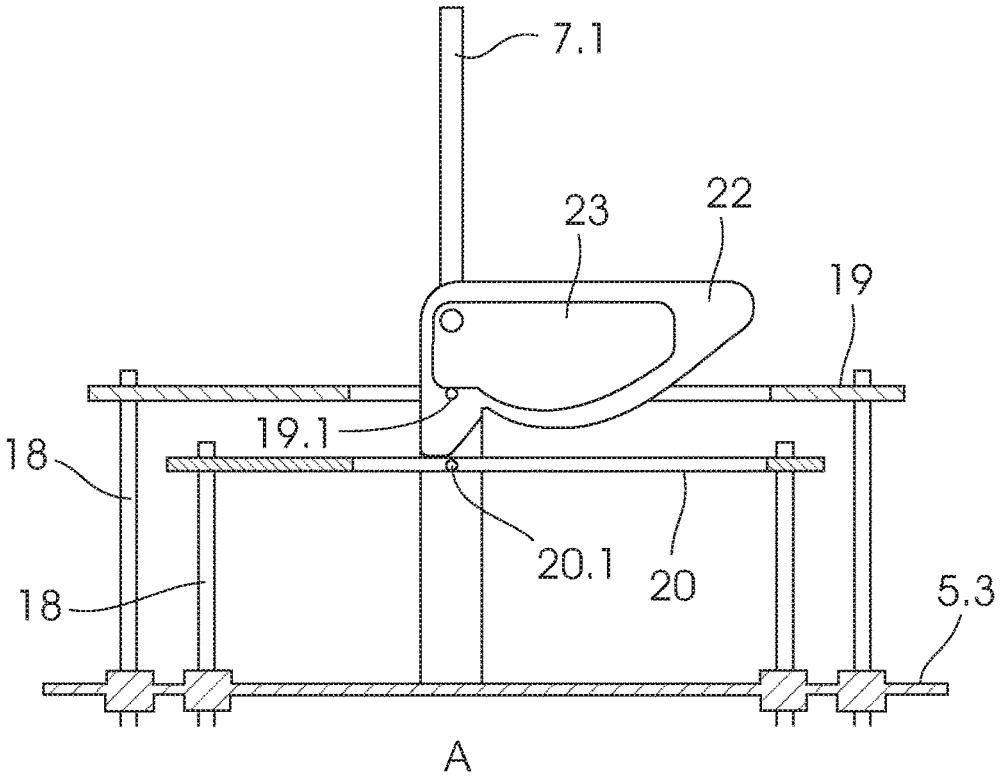
FIGS. 7 & 8 provide a further four cross-sectional schematic views of additional components of the movement means for legs of a lifting device.
Figure 7:
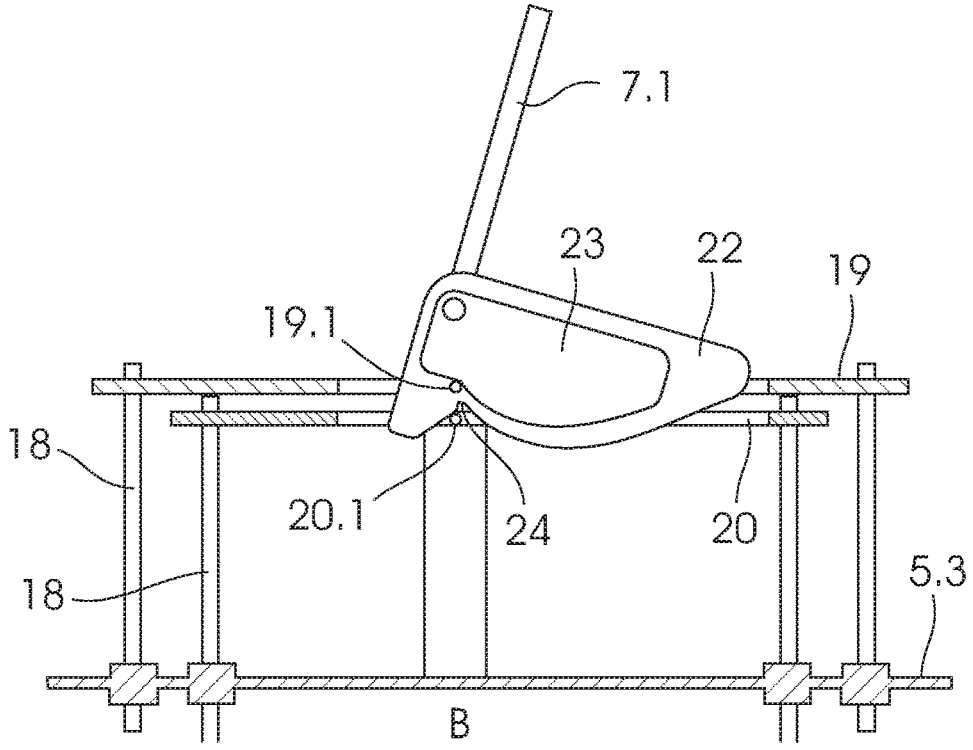
Figure 8:
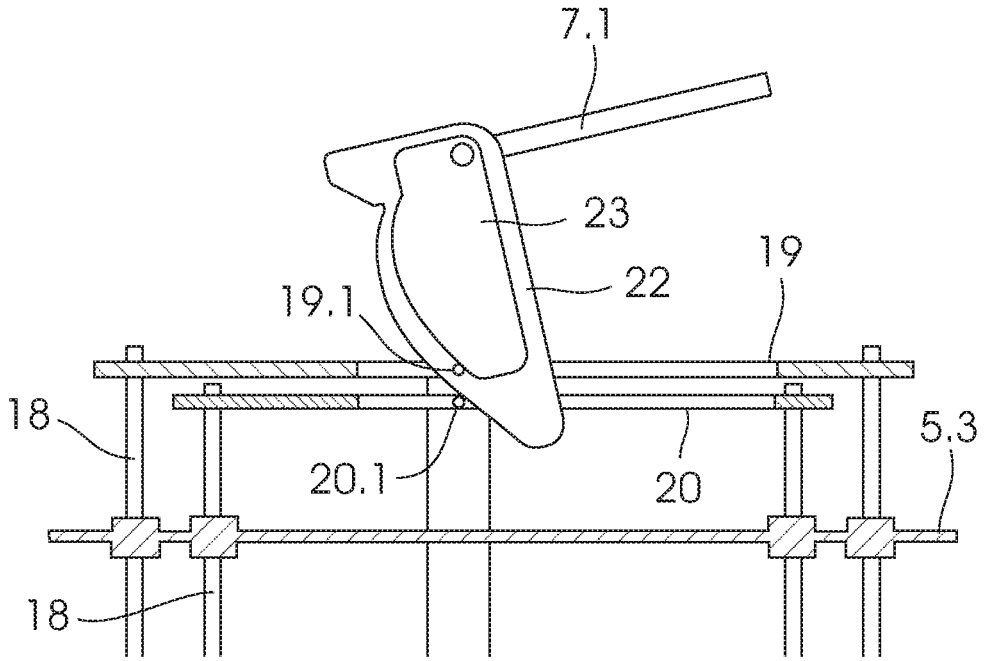
Figure 8:
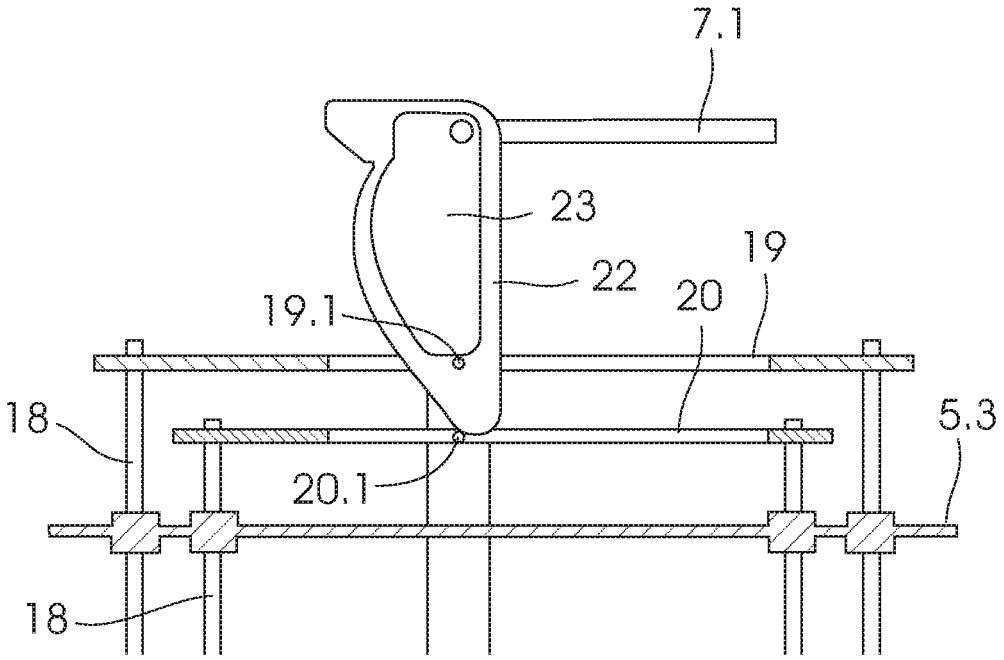
Figure 9:
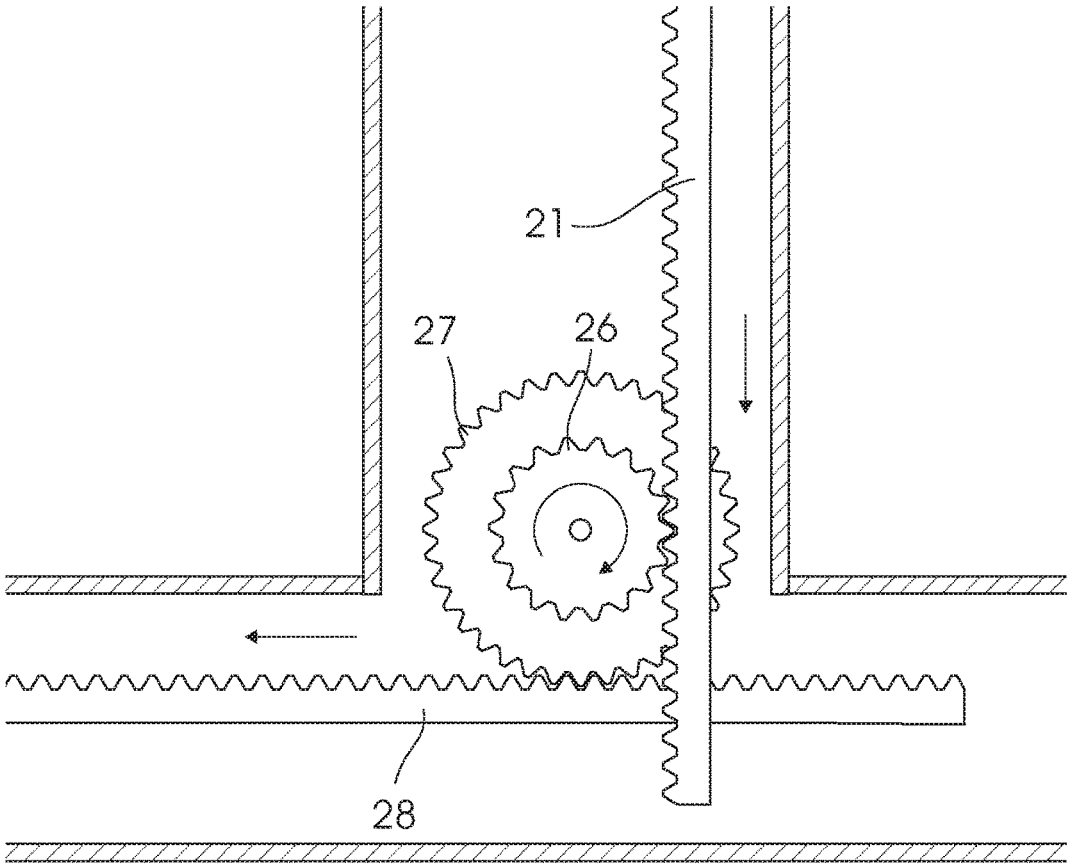
FIGS. 9 & 10 are schematic views of still further components of the movement means for legs of a lifting device.
Figure 10:
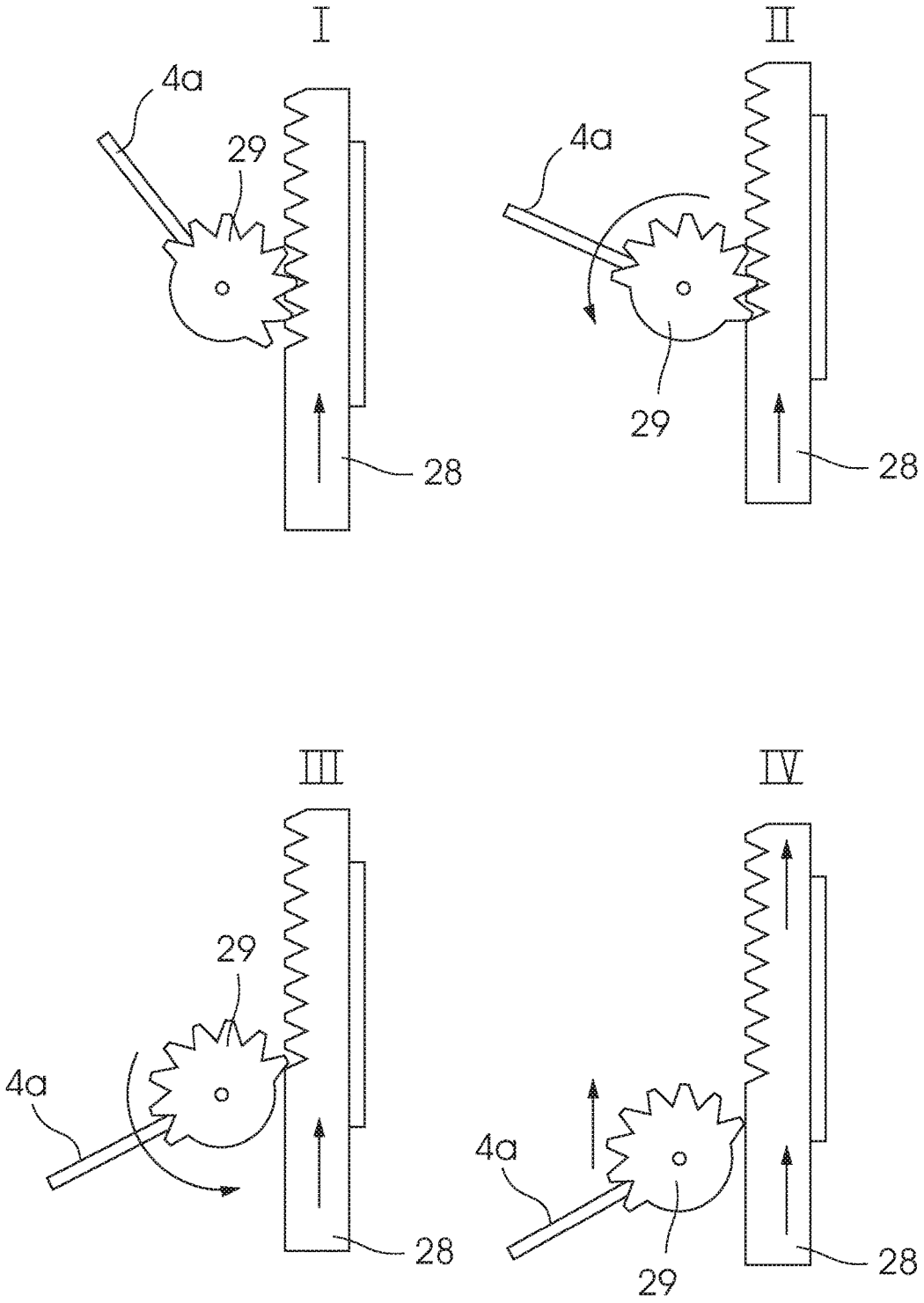

This displacement of the linear gear (21), as the cams (22) and (23) are moved from the positions in view B to view C of FIGS. 6 to 8, in turn drives gear (26) located adjacent the bottom of the post (3)—see FIG. 9. The gear (26) is secured to a coaxial gear (27), which actuates a second linear gear (28).

The second linear gear (28) in turn drives partially cogged gear (29) (shown in the detail view B of FIG. 5 and in FIG. 10) attached to one of the legs (4*a*). The movable legs (4*a*) have partially cogged inner ends (30) and (31) which provide synchronised movement of the legs (4*a*), which corresponds to the rotation of the cogged gear (29).

Thus, between arrangements B and C, as the lifting arm (7) is lowered, legs (4*a*) move operatively forward towards the stabilized position. When linear gear (28) moves past the cogged portion of gear (29) (as per illustration IV in FIG. 10), gear (28) and gear (29) are no longer meshed and legs (4*a*) are locked into the stabilized position. An attempt to move the legs (4*a*) by applying force to the legs (4*a*) themselves will not have any effect as the cogs are no longer meshed and gear (29) only exerts a force transverse to the direction of travel of linear gear (28) thereon.

As the lifting arm (7) is lowered further into the weight carrying, supporting position wherein the lifting arm (7) extends laterally relative to the post (between arrangements C and D in FIGS. 6 and 8) the second follower (20) is again displaced away from the first follower (19) sufficiently to cause the wedges (25) to disengage from linear gear (21). This assures that any vertical movement of the head (5) relative to the post (3) with the lifting arms (7.1) in the supporting position, will not have an effect on linear gear (21) and hence the movement of legs (4*a*).

The lifting device (1) is designed to enable a person who does not have the use of the lower extremities of their body to transfer himself or herself from one seated position to another seated position, on a different support as described below, without the assistance of another person.

A typical example of when such transfer is required is where the disabled person needs to be moved from his bed to a lavatory. To do so, using the embodiment described, a person will lower the lifting arm arrangement (7) to the lateral, supporting position, consequently moving the legs (4*a*) into the extended position. These two positions correspond to the stabilizing condition of the base (2) referred to.

The person positions himself in the sling (110), moves the lever (6) to the first protrusion (11.1), and rotates the lever (6) to raise himself from the bed. Once the person is raised clear of the bed, he will move the lever (6) to the second protrusion (11.2) and turn the lever (6) to rotate himself about the post (3) until he is positioned above his wheelchair (34). He will then move the lever (6) back to the first protrusion (11.1) and rotate the lever (6) in the opposite direction to be lowered onto the wheelchair (34).

The person then removes himself from the sling (110), and raises the lifting arm arrangement (7) to the inoperative position. The lifting device (1) is now in mobile mode and legs (4*a*) are in the folded position and the base (2) in the retracted condition. The person will position himself with his wheelchair (34) such that the post (3) is between his legs as indicated in FIG. 3. Having legs (4*a*) in the folded position allows the wheelchair (34) to move close to the post (3). He may thus move the lifting device (1) along with his wheelchair (34).

The procedure described is reversed once the person is in the bathroom. He will again position himself in the sling (110), raise himself by rotating the lever (6) on the first protrusion (11.1), rotate himself to above the lavatory by rotating lever (6) on the second protrusion (11.2), and lower himself onto the lavatory seat by rotating lever (6) on the first protrusion (11.1).

For the operation described, the device (1) is required to be sufficiently stable or steady so that the person can safely rotate 360 degrees about the post (3). It is further required that the effective width of the lifting device (1) or its base (2) should be small enough for the device (1) to be moved through a standard width doorway.

These two requirements present a typical engineering problem in that the stability of the device (1) whilst rotating would be compromised in the direction of least effective width of a supporting base and it is not practical to increase the effective width of the base to greater than the width of a standard doorway. If the width of the base is limited to that of a standard width doorway, the lifting arms would have to be of such a short length that would make it unfeasible or impractical to carry a person in the sling (110).

In accordance with the current invention, the problem is overcome by having the base (2) movable between the expanded stabilizing condition and the retracted condition. The movable legs (4*a*), which in the stabilizing condition, extend radially outwardly, provide the base (2) of the lifting device (1) with an effective width "x" which is greater than that of a standard doorway. Whereas, when the base (2) is moved into a retracted condition with the legs (4*a*) folded respectively towards adjacent legs (4), the effective width "y" of the device (1) is smaller than the standard width of a doorway.

The wheels (8) of the base (2) are arranged substantially equally spaced apart on a diameter about the post (3) when the base (2) is in the stabilizing condition. In this condition, the stability of the device (1) is not compromised in any direction.

The configuration and dimensions of the components for the various mechanisms illustrated in the accompanying schematic drawings will be within the design competence of a suitably skilled person.

A person skilled in the art will appreciate that a number of variations may be made to the features of the embodiment described without departing from the scope of the invention. For example, instead of using linear and rotating gears to transfer the vertical movement within the post to horizontal movement at the base, cranks, cams, linkages, chains, a combination of the preceding mechanisms, or any other mechanisms to effect the required movement may be used. Furthermore, instead of having two protrusions and a detachable lever, two separate levers may be used for rotation and raising/lowering of the head relative to the post. Alternatively other mechanisms, such as switch-operated hydraulic, pneumatic or electric actuation may be used to affect rotation and elevation of the head as well as folding and locking of the movable legs.

The invention claimed is:

1. A mobile lifting device comprising a wheeled base with a post extending from the base, the post movably supporting a head for upwards and downwards movement, and the head having a lifting arm arrangement attached thereto, characterised in that the head is rotatable about the post through at least 180 degrees for transfer of a disabled person onto and from a wheelchair, wherein the head includes an actuator, for movement relative to the post, accessible to the person supported by the lifting arm and wherein the actuator is rotatable in opposite directions to rotate the head alternatively about the post, the post being located centrally relative to the base to provide stability as the arm arrangement on the head is rotated about the post while supporting the disabled person and the device is configured for operation, to move the head upward and downward on the post and to rotate the head about the post, by the disabled person using the device and for movement with a wheelchair by the disabled person when using the wheelchair; wherein the base is movable between an expanded stabilizing condition and a retracted condition and configured for operation, to move the base between the stabilizing condition and the retracted condition, by the disabled person using the device and wherein the lifting arm arrangement is pivotably secured to the head and movable between a supporting position and an inoperative position, and the arm arrangement is connected to the base through a linkage which moves the base into the stabilizing condition when the arm arrangement is in the supporting position and moves the base into the retracted condition when the arm arrangement is in the inoperative position.

2. A lifting device as claimed in claim 1 including a plurality of casters for ground contact.

3. A lifting device as claimed in claim 1 in which the head is rotatable about the post through 360 degrees.

4. A lifting device as claimed in claim 1 in which the base includes a plurality of legs extending radially from the post.

5. A lifting device as claimed in claim 1 in which the linkage secures the base in the stabilizing condition while the arm arrangement remains in the supporting position.

6. A lifting device as claimed in claim 1 in which the lifting arm arrangement includes a pair of spaced apart arms extending from a cross-beam pivotably secured to the head.

7. A lifting device as claimed in claim 6 wherein the arms when in the supporting position extend laterally from the head and in the inoperative position extend upwardly from the head.

8. A lifting device as claimed in claim 1 in which wheels of the base are disposed concentrically about the post when the base is in the stabilizing condition.

9. A lifting device as claimed in claim 8 in which the base includes a plurality of legs extending radially from the post in the stabilizing condition, with at least one of the legs being movable from a radial position towards an adjacent leg to bring the base into the retracted condition.

10. A lifting device as claimed in claim 9 having five legs, two of which are hingedly connected to the post and foldable towards adjacent legs.

11. A lifting device as claimed in claim 1 in which the actuator is a rotatable handle provided on the head.

12. A lifting device as claimed in claim 11 in which the handle turns an outer rotary gear, rotatably supported in relation to the head that runs on track provided by an inner annular gear, which is coaxial and fixed relative to the post.

13. A lifting device as claimed in claim 11 in which the handle is rotatable in opposite directions to respectively raise and lower the head on the post.

14. A lifting device as claimed in claim 13 in which the handle axially turns a screw-threaded rod rotatably fixed to the head which extends through a correspondingly screw-threaded bore in a carrier fixed to the post.

* * * * *